United States Patent [19]

Menard

[11] Patent Number: 4,614,233

[45] Date of Patent: Sep. 30, 1986

[54] MECHANICALLY ACTUATED DOWNHOLE LOCKING SUB

[76] Inventor: Milton Menard, 111 Iota St., Belle Chase, La. 70037

[21] Appl. No.: 659,696

[22] Filed: Oct. 11, 1984

[51] Int. Cl.[4] ..... E21B 23/02

[52] U.S. Cl. ..... 166/206; 166/240

[58] Field of Search ..... 166/214, 215, 240, 211, 166/136, 206

[56] References Cited

U.S. PATENT DOCUMENTS 3,381,750 5/1968 Brown ..... 166/214

4,295,528 10/1981 Carmody ..... 166/381

*Primary Examiner*—James A. Leppink

*Assistant Examiner*—Matthew Smith

*Attorney, Agent, or Firm*—Keaty & Keaty

[57] ABSTRACT

A mechanically actuated downhole locking sub is capable of locating and locking into a doubly tapered downhole landing nipple adapted to a magnetically coded, electrically actuated lock. The sub permits the substitution of mechanical actuation for electrical or explosive actuation within a drillstring or a wireline run for setting and releasing downhole tools within an oilwell without requiring a changeout of the landing nipples, which may be set in the casing or be otherwise unremovable. The mechanism includes a specific spring biased split locking ring design which permits the mechanical locks of the tool to be set in a cocked position downhole and then to be positively locked upon engagement with a landing nipple where the tool is raised. An internal engagement mechanism, mechanically connected to the fishneck of the tool, permits the locking ring to be disengaged subsequent to landing and locking the tool, thereby cocking it for removal. The lock is functional with locking dogs having both an upper and a lower taper, compatible with the magnetically actuated or set landing nipples; the mechanism disclosed provides a positive locating and locking capability, overriding the unlocking force created by the chamfered landing nipple.

5 Claims, 11 Drawing Figures

MECHANICALLY ACTUATED DOWNHOLE LOCKING SUB

BACKGROUND OF THE INVENTION

Within the field of oilwell production and drilling, a series of adapters and techniques have been developed to permit the placement of apparatus in a positively locked in position within the oilwell bore hole. Since some of the apparatus so positioned is designed to resist extreme back pressures and other anomalous conditions, a positive mechanical connection is required between the supporting lock and the oilwell borehole casing.

Initial locks of this nature were mechanically actuated. They function by expanding a plurality of locking dogs or latches into a mating groove or landing nipple firmly set within the overall well casing. The primary force these mechanical locks must resist is a sudden upward force induced by a blowout or a kick from deep within the well. The locking dogs are formed having essentially flat upper surface designed to engage with a flat annular region within the landing nipple, providing positive locking and engaging for mechanical linking of the lock to the landing nipple.

Since it is necessary, in practical use, that a lock be lowerable past a series of landing nipples until a desired location is reached downhole, the lower ends of the locking dogs have been beveled to permit them to pass, in sequence, a series of landing nipples. The lock is therefore set by lowering it past the desired landing nipple and then raising the drillstring until the lock positively engages. The accurate placement of such a lock has proven to be a problem and the subsequent removal of the lock is not always feasible.

As a result of the difficulty of accurately locating the desired landing nipple downhole, a series of magnetically coded and actuated lock mechanisms have been developed. These mechanisms code the landing nipples by stacking a series of permanently magnetized rings above the landing nipple. The rings are oriented in an arbitrary sequence of magnetic poles, so as to provide a particular magnetic pattern immediately above the nipple, identifying each individual landing nipple by the uniqueness of the pattern formed. A running tool supporting the lock to be lowered is then coded by providing a series of magnetic sensors chosen to match the magnetic pattern of the desired nipple. The running tool and the lock are lowered in a drillstring past each of the landing nipples in turn until the landing nipple is reached where the coded magnetic pattern matches that of the running tool. The identity of the magnetic fields is sensed to trigger an electrically fired explosive charge, providing propulsive power to expand and set the locking dogs within the landing nipple.

Such a magnetically coded setting lock is extremely precise. However, the requirement for explosive actuation, the necessity for precise detection of the magnetic fields, loss of the magnetic coding with age, and certain other problems associated with the reliability and safe performance of the running tool, make it desirable to have a capability of mechanically running and setting a lock within a landing nipple designed for magnetic actuation.

The design of the magnetically set locks is such that the landing nipple locking grooves have bevels both on their top and their bottom sides. The prior art mechanical locks cannot be used in such an environment as an over pressure on the mechanical lock will cause the dogs to be cammed in by the beveled upper surface of the nipple groove overriding the mechanical lock, and whatever devices are affixed to it. Since the primary purpose of the downhole landing nipple and lock mechanism is to set pressure resistant structures such as BOPs (blow out preventers) and similar emergency closing valves, such a situation is obviously unacceptable. Thus, it is considered in the current art that mechanical locks and running tools are totally incompatible with a casing string or tubing string which is made up with magnetically coded landing nipples. Likewise, a magnetically set locking mechanism cannot be utilized in a mechanically oriented casing and nipple string inasmuch as there are no magnetic segments to provide the locating signals necessary to activate a magnetically coded running tool and lock.

SUMMARY OF THE INVENTION

It is the object of this invention to provide a mechanically actuated running tool and lock which is mutually compatible with mechanically or magnetically set landing nipples.

To this end, an alternate combination of locking methods is shown that insures positive location and engagement of locking dogs within the landing nipple annular recess, with the locking dogs being of a shape compatible with a landing nipple shaped for a magnetically actuated lock. For this reason, the particular mechanical lock of the invention has locking dogs which are beveled on both the upper and lower surfaces thereof.

The basic employment environment of a downhole locking mechanism is such that for both mechanical and magnetically actuated locks, as well as the lock of the current invention, the overall diameters, general shape, and configuration including the existence of locking dogs compatible with landing nipples, the running tool used for setting and removing the lock, and the attachment provisions provided on the lock to support the actual mechanism being held downhole, must all be identical. It is important, therefore, to realize that it is the specific combination of mechanical features providing compatibility with magnetically coded landing nipples which provides the different structure of the lock of the current invention over prior art mechanical locks.

It is important to realize that the mechanical lock of the invention is used in combination with a prior art running tool, which is a mechanism designed to set and also to remove the lock under the control of the operator of the overall drillstring and well.

It is thus an object of this invention to provide a mechanical downhole locking mechanism which can be run, set, and removed from magnetically coded landing nipples.

It is a further object of this invention to provide a mechanically actuated downhole lock, which is capable of mechanically locking into a landing nipple without requiring the landing nipple to have a non-beveled, flat upper groove.

It is a further object of this invention to provide a mechanical lock and running tool combination which is capable of accurately locating and setting into a landing nipple of general design, while still permitting ready removal of the lock upon need.

It is a further object of this invention to provide a downhole lock of the characteristics described above which is capable of resisting full downhole pressure, thereby supporting blowout preventers or the like.

These and other objects of the invention are more apparent from the detailed description of the preferred embodiment which follows, which describes the specific mechanism and structure necessary to provide these capabilities.

DETAILED DESCRIPTION OF THE PREFERRED EMBODIMENT

Figure 1:
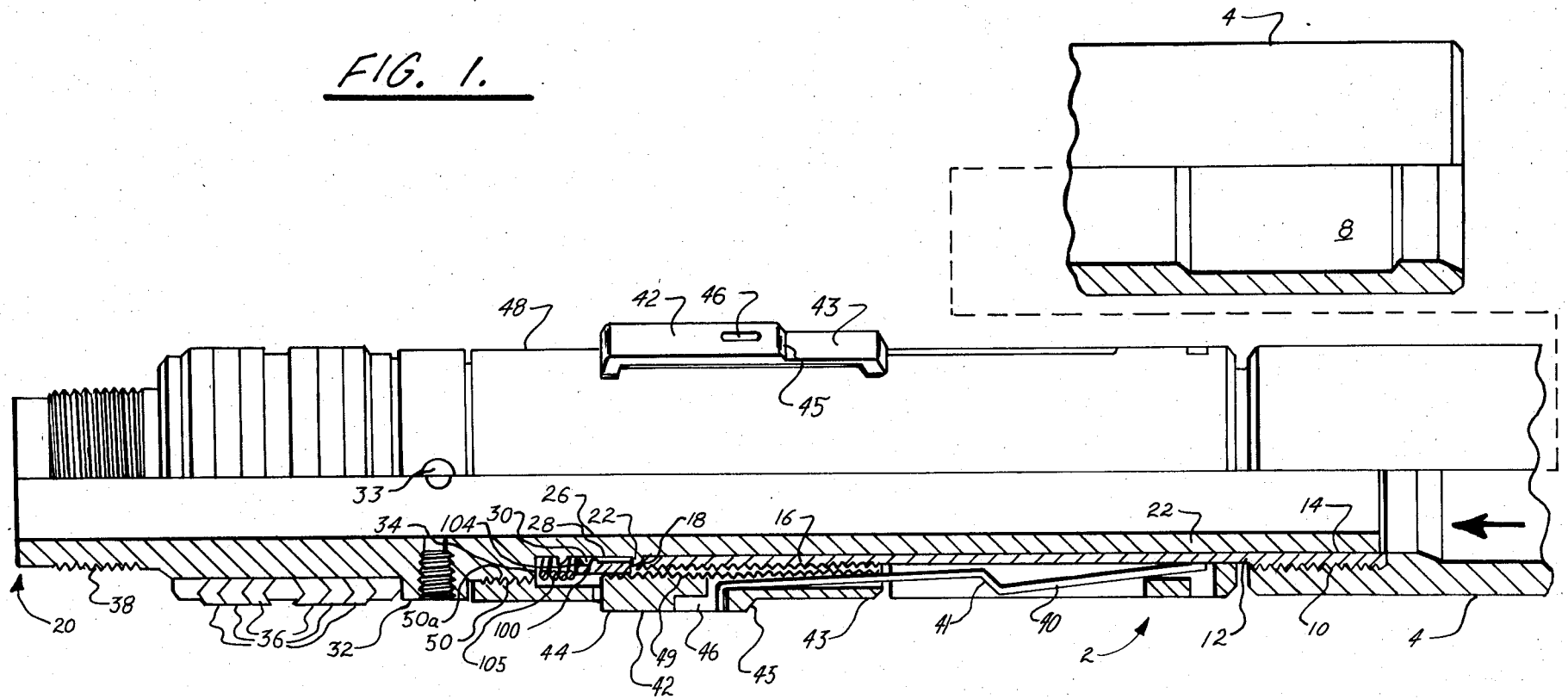
FIG. 1 is an elevational view of the lock of the present invention, with a part cut off to show a sectional view of the expander sleeve mounted onto the packing mandrel.
Figure 2:
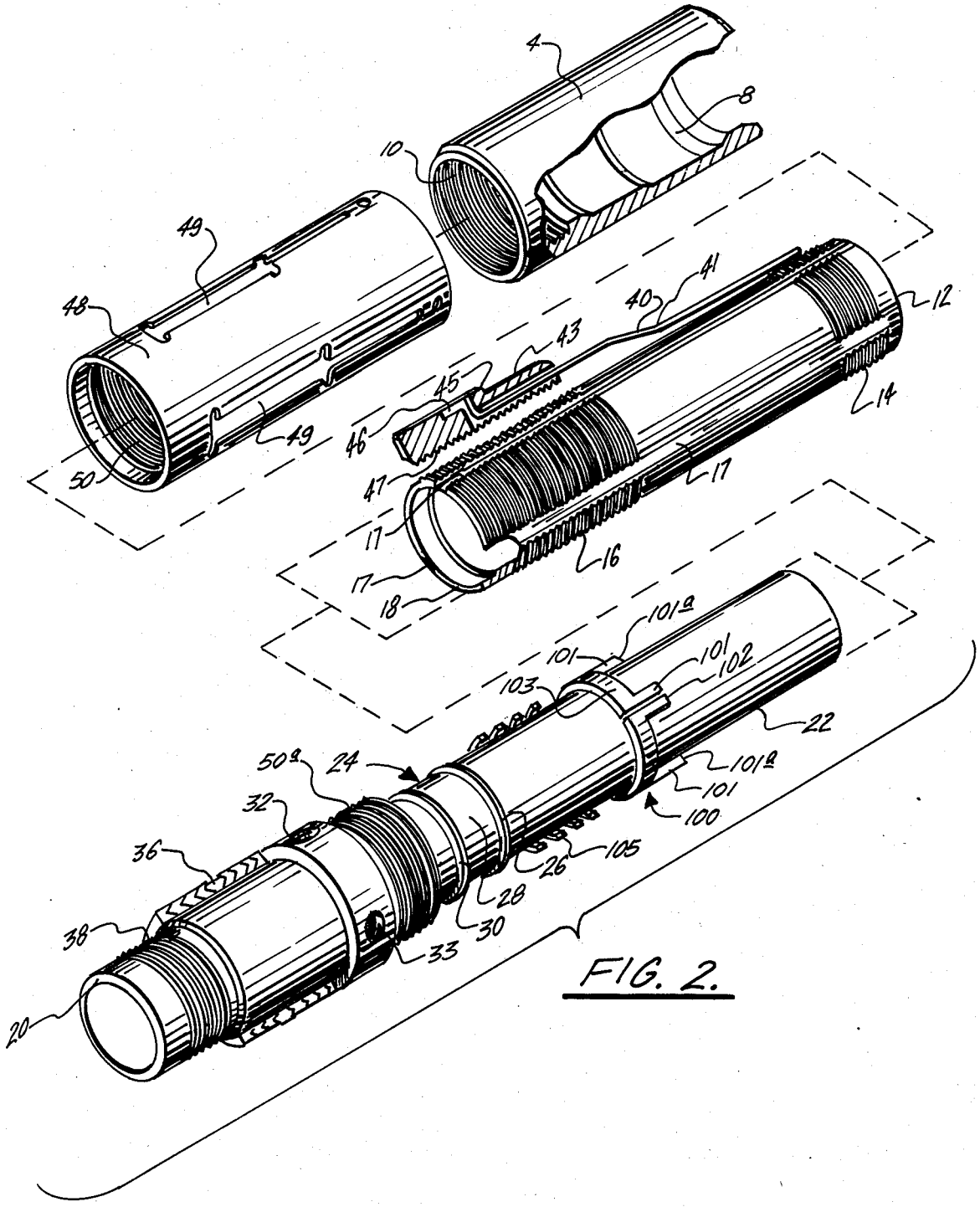
FIG. 2 is an exploded view of the apparatus of the present invention, with a part of the fish-neck cut off to show the internal groove.
Figure 3:
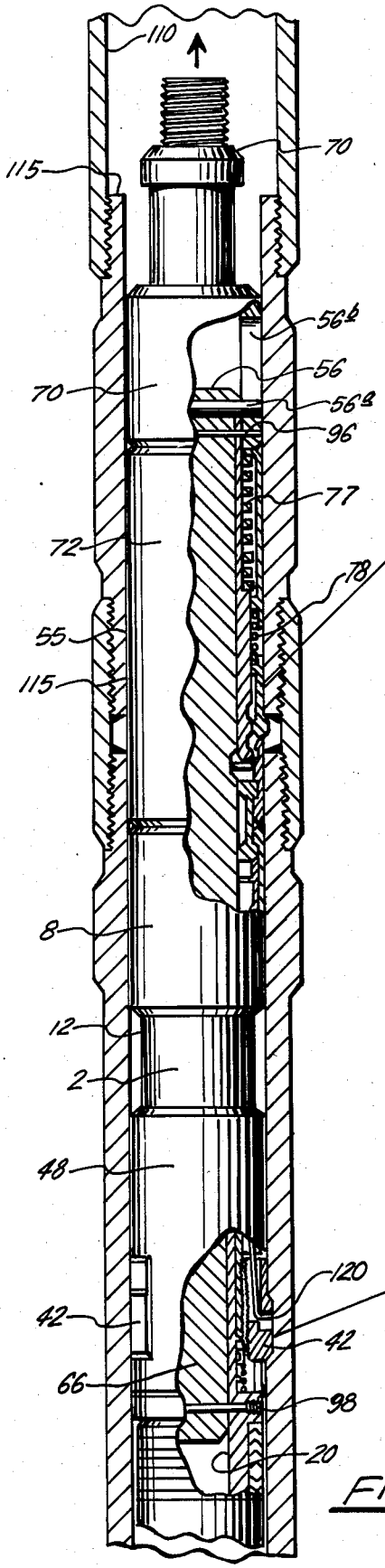
FIG. 3 is an elevational, partially sectional view of the apparatus of the present invention assembled with a running tool and ascending from a section of an oil well bore.
Figure 4:
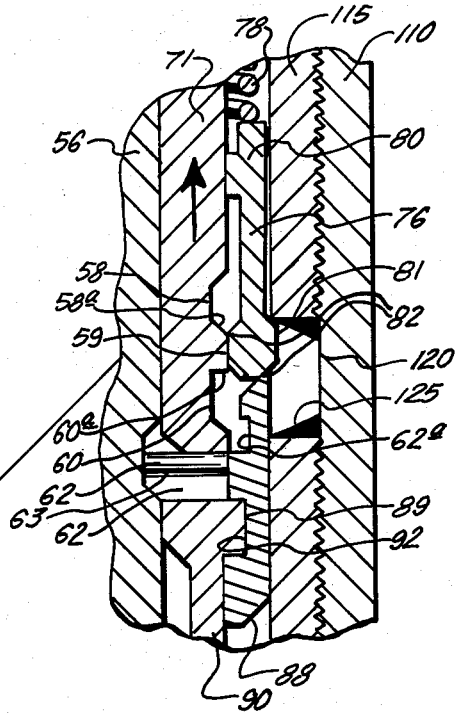
FIG. 4 is a sectional view of a part of the running tool showing in detail the position of a locating dog approaching a lower locating dog recess.
Figure 5:
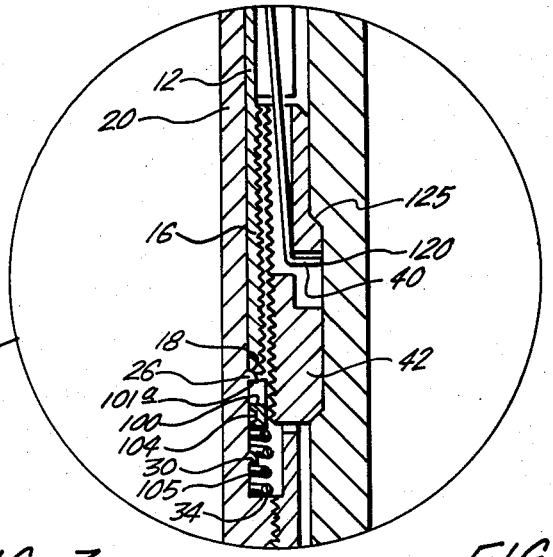
FIG. 5 is a sectional view of a part of the lock of the present invention illustrating in detail a locking dog engaged with a landing nipple.
Figure 6:
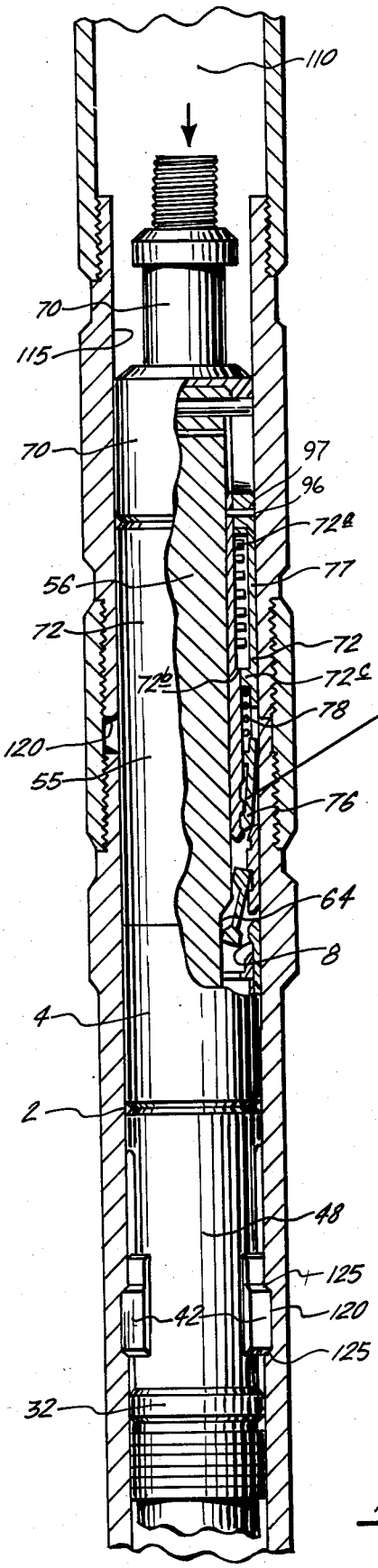
FIG. 6 is a sectional, partially elevational view showing running tool and the lock of the present invention being inserted into the oilwell bore.
Figure 7:
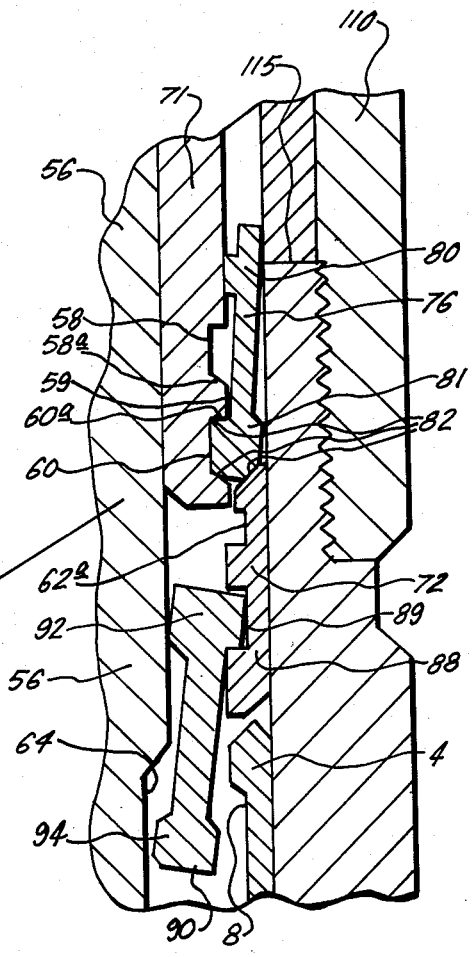
FIG. 7. PRIOR ART
FIG. 7 is a sectional view of a part of the running tool, illustrating in greater detail the position of a locating dog when the running tool descends freely through a polished bore.
Figure 8:
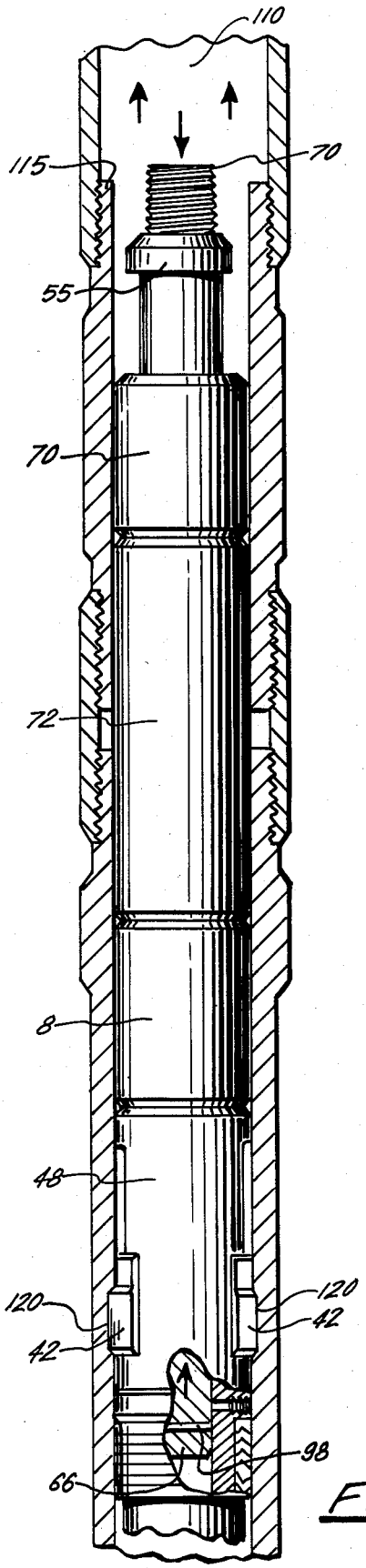
FIG. 8 is an elevational, partially sectional view of the lock of the present invention being set within the oilwell bore.
Figure 9:
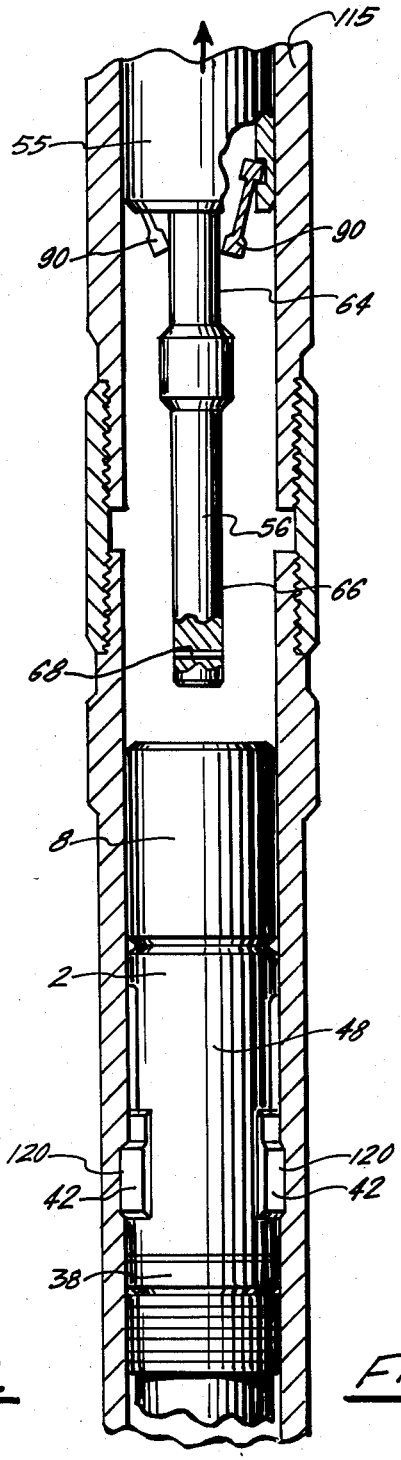
FIG. 9 is an elevational, partially sectional view showing the running tool being removed from the well bore, leaving the lock of the present invention engaged with a landing nipple.
Figure 10A:
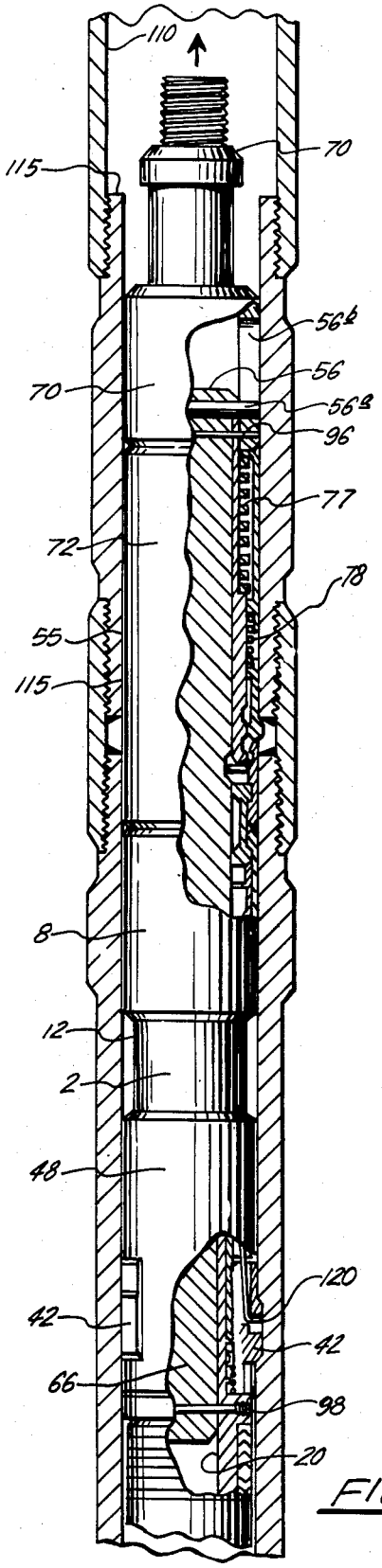
FIG. 10*a* is an elevational view of the apparatus of the present invention assembled with a running tool.
Figure 10B:
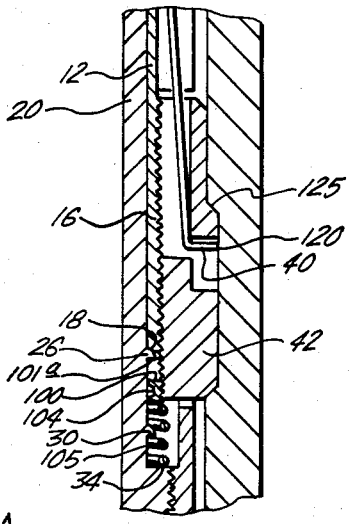
FIG. 10*b* is a sectional view of the apparatus of the present invention showing in detail engaging between serrations of the expander sleeve and the locking dog.

Referring to the figures, the M-X Lock of the current invention 2 is shown comprising at its upper end a fishneck section 4. Fishneck 4 is a cylindrical upper structure having at its interior upper edge an internal circumferential fishneck recess groove 8 and at its lower end an internal circumferential fishneck connecting thread 10. Connected into fishneck 4 by threading into threaded section 10 is the tool expander sleeve 12. Expander sleeve 12 comprises a downward extending hollow cylindrical structure, affixed to expander sleeve upper thread 14 into fishneck threaded section 10. Expander sleeve 12 extends downward to a lower serrated section 16 of greater overall diameter than the remaining diameter of expander sleeve 12. The lower serrated section 16 is provided with a plurality of lengthwise dog receiving grooves, extending the length of expander sleeve 12, periodically spaced above the circumference of expander sleeve 12. Grooves 17 each comprise a lengthwise smooth section along the surface of sleeve 12 adapted for the sliding of metallic objects. The lower end of expander sleeve 12 defines an end face 18 of substantially flat cross section.

Slidingly disposed within expander sleeve 12 is found packing mandrel 20. Packing mandrel 20 is a substantially hollow cylindrical member having an inner open circular aperture adapted to receiving a running tool mandrel as will hereinafter be discussed. Packing mandrel 20 has an upper section 22 of diameter adapted to closely but slidingly fit within expander sleeve 12. Immediately below upper section 22 is found a midsection 24, of substantially the same internal and external diameter, but comprising in vertically spaced relationship three elements: an upper stop ridge 26, which is circumferentially disposed about the outer surface of midsection 24; beneath upper stop ridge 26 a substantially smooth lock ring slide section 28; and immediately beneath slide section 28 a lower lock ridge 30 of an essentially triangular cross section circumferentially extending outward from the outer face of midsection 24.

Immediately beneath midsection 24 of packing mandrel 20 the external diameter of packing mandrel 20 is enlarged to equal substantially the overall diameter of the entire M-X lock, creating lower sleeve section 32. Within lower sleeve section 32 is found a lower shear pin apperture 33. Lower sleeve 32 terminates at lower sleeve base end 34, which forms a support for a series of Chevron sealing packers 36. The overall mandrel 20 terminates at the lower end of lower sleeve section 32 in API pin section 38, which is adapted for supporting other pipe, tool, or sub sections within a made up drillstring.

Mandrel 20 and sleeve 12 form a coaxially disposed structure. The exterior of 2 is formed by a third coaxial cylinder member, locking dog sleeve 48. Locking dog sleeve 48 is substantially a coaxial cylindrical structure, enclosing sleeve 12 and mandrel 20. It is connected at a lower end by means of lower threaded connections 50 to a mating threaded connection 50A on lower sleeve member 32. It will thus be seen that the combination of sleeve 48 and mandrel 20 form a single connected structure, coaxially enclosing expander sleeve 12. At the upper end of locking dog sleeve 48 is provided an inner retention lip member 51, designed so as to restrict the interior diameter of sleeve 48 to a diameter slightly greater than that of expander sleeve 12 but less than the diameter of sleeve serrated tooth section 16. Circumferentially about locking dog sleeve 48, co-located in number and spacing with linear grooves 17 are found a plurality of locking dog apertures 49.

Within locking dog sleeve 48, disposed between locking dog sleeve 48 and linear grooves 17 are found a plurality of locking dogs 42. One locking dog 42 is disposed within each groove 17. Locking dogs 42 comprise an upper tail member 43 retained between groove 17 and the interior of locking dog sleeve 48 and a head member 44, retained within linear groove 17 but extending outward through locking dog aperture 49. Each of locking dog head 44 is provided with an upper and lower slip bevel 45 along its outerface. Each locking dog 42 further has an internal spring recess 46 for retaining an S spring 40 which extends upward past the tail 43 and is retained within sleeve 48 against sleeve 12.

The exact outer profile of locking dogs 42 is determined to match landing nipple 120 profile. Thus various nipples 120 will require various profiles for head 44.

It is found that at least 3 locking dogs 42 should be present to provide optimum centering of the lock 2 within the oil well bore 110. It should be noted that expander sleeve 12, while coaxially restrained between mandrel 20 and locking dog sleeve 48, is free to move in a vertical direction. It is restrained against upward movement by the retention of the lower serrated teeth section 16 by outer sleeve retention lip 51. It is restrained against motion in a lower direction or telescoping direction by the contact of fishneck 4 with locking dog sleeve 48. Spring 40 is provided with an inward spring bend 41 at a point which is below end face 18 when expander sleeve 12 is in its upward limiting position, but is above end face 18 when expander sleeve 12 is in a lower position.

Annularly disposed on mandrel 20, circumferentially surrounding lock ring slide section 28, is found split lock ring 100. Split lock ring 100 comrpises a springlike metallic ring having a plurality of fingers 101 which correspond in number and in spacing to the spaces between the plurality of locking dogs 42. Each of the fingers 101 ends in a substantially square finger end 101A defining an upper cylindrical end surface to the overall lock ring 101. Longitudinally along one of the fingers 101 is found split 102, which permits ring 101 to be expanded from its normal static diameter. At the base of and connecting each of the fingers 101 is found ring member 103, circumferentially surrounding lock ring slide section 28. Ring 103 is of a diameter substantially less than either of upper stop ridge 26 or lower lock ridge 30. Circumferentially within ring 103 is disposed an inner, annular groove 104, adapted to engagingly mate with lower lock ridge 30. Bias spring 105 is compressed beneath ring 103, biasing ring 103 in an upward direction along lower sleeve 32.

S spring 40 is a double acting spring. When expander sleeve 12 is in an upward position such that innerbend 41 is below the position of end face 18, spring 40 biases locking dogs 42 in an inward direction tightly against mandrel 20, adjacent slide section 28. All of locking dogs 42 thereby retain ring 103 in a downward position, immediately above lower lock ridge 30, against the force of bias spring 105.

Locking dogs 42 are provided upon an inner surface adjacent mandrel 20 with inner serrations 47. Inner serrations 47 are of a depth and spacing corresponding to lower serrated section 16 of expander sleeve 12.

The understanding of the operation of inventive tool 2 requires a description of the prior art running tool 55 to which the M-X lock 2 is adapted and which is necessary to support, actuate, and set the M-X lock downhole.

Running tool 55 consists of three major coaxially disposed components: core 56, upper collar and sleeve 70, and locating dogsleeve 72.

Core 56 is a solid, substantially strong linear columnar rod. Vertically disposed along core 56 are, first, core retention lugs 56 A, receivingly and slidingly engaged in core retention slots 56 B. Upper shearpin aperture 57, located in the upper end of core 56, is adapted for receivingly engaging a shear pin 96 therein. At a first upper point along core 56, beneath shear pin aperture 57, is located upper locating dog recess 58. Upper locating dog recess 58 is provided with lower beveled edge 58 A. Immediately beneath upper locating dog recess 58 is found an extended flat top locating dog ridge section 59. Immediately beneath ridge section 59 is found a second, lower locating dog recess 60. Lower recess 60 is of identical shape to upper recess 58, and has upper, straight edge 60A. At a point beneath lower locating dog recess 60 is found a release lug recess 62, adapted to receiving and engaging a release lug 63. At a point below release lug recess 62 is found a retaining dog recess 64, which recess is a substantial narrowing for a length of the diameter or cross-section of core 56. Reduced section 64 of core 56 is continued for a distance as shaft 66, terminating at a lower point; immediately above this lower point is found lower shear pin aperture 68.

Running tool 55 is connected to the drillstring with which it is manipulated by running tool collar or socket 70. Upper collar 70 is connected securedly by means of shear pin 6 to core 56 at shear pin aperture 57. Extending downwards, fixedly connected thereto, from upper collar 70 is midsleeve 71. Midsleeve 71 coaxially encloses core 56 and in turn is coaxially enclosed by external running tool locating dog sleeve 72 which forms a slidably connected, cylindrical circumferential outer member to running tool 55. Sleeve 72 coaxially encloses midsleeve 71 and thereby encloses core 56.

Locating dog sleeve 72 has, spaced about its periphery at least two locating dog apertures 73. Concentrically disposed with each locating dog aperture 73 within coaxial midsleeve 71 is a midsleeve locating dog aperture 74. Within locating dog apertures 73 and 74 are located, one per aperture, locating dogs 76. Locating dogs 76 are of a form comprising a locating dog alignment tail 80 at an upper end and a locating dog engaging head 81 at a lower end. Locating dog engaging head 81 is provided with sloped bevels 82 on its lower inner and upper and lower outer faces.

Locating dogs 76 are supported for sliding vertical movement within locating dog apertures 73 and 74 by a dual biased spring arrangement as follows. A substantially strong upper core spring 77, biasingly supported between an upper supporting ridge 72A on locating dog sleeve 72 and lower ridge 72B on sleeve 71 comprise a first substantially strong bias force against downward movement of locating dog 76. Below ridge 72A, bearing between dog sleeve ridge 72C and locating dog 76 is lower bias spring 78 which provides a bias against upward movement of locating dog 76. The downward bias of spring 78 is substantially less than the bias of spring 77. As a result there is a substantially greater bias force tending to support locating dogs 76 against free downward movement than bias force supporting dogs 76 against upward movements. Locating dogs 76 are vertically located by the combined forces of bias springs 77 and 78 such that, the normal position of dog engaging head 81 is adjacent to and supported upon dog ridge 59.

Referring to the figures, immediately beneath locating dog 76, is a lower section of locating sleeve 72 dog pusher sleeve section 88. By engagement of retention dog annular groove 89, sleeve 88 retains fishneck retention dogs 90 by clasping a section of retention dog tail member 92. The normal position of sleeve 72 is such that retention dogs 90 are supported within section 88 upon inner mandrel 56, with dog heads 94 grippingly engaged into fishneck recess 8. The lower edge of sleeve 88 further contactingly engages the upper end of fishneck 4.

Within section 88, a space above groove 89, is release lug outer receiving annular groove or recess 62A.

In brief, operation of the apparatus of the present invention can be described as follows.

After lock 2 has been attached to running tool 55 by the lower shear bolt 98 and by retaining dogs 90 connected to fish neck 4, the assembled tool is lowered down the well bore 10 to a point beneath the desired landing nipple 120.

As the tool is lowered into the bore, the locating dog 76 of running tool 55 is riding against a substantially weak lower spring. As a result, as the locator dog 76 engages the lower locating dog recess 60, locator dog 76 will spring outwards, but further lowering of the tool will tend to push it upward against the wicker spring causing it to fall into an upper locating dog recess 58, permitting the tool to proceed pass the recess. The locating dog 76 is held in the recess by the retaining ridge, further upward movement forces the locating dog 76 and its associated sleeve 72 downwards against the force of the stronger upper spring 77. The compressive force of the upper spring forces the locator dog into the lower recess. The retainer dog sleeve rides upon the lock fish-neck 4, the expander sleeve is pushed onto the dog, causing spring 40 to push outward locking dogs 42, into the desired landing nipple. The lock spring 41 forces the lock ring 100 upwards to a point behind the locking dogs 42, thereby allowing the lock ring 100 to prevent locking dogs 42 from retracting and preventing the tool from moving upward any further. This operation allows setting of the tool into place. Once locking engagement is detected by a wire line operator (sudden increase on the tension of the wire line), the direction of the running tool is reversed and it is being pulled upward. This action shears the upper shear pin 96, and the entire sleeve assembly, including the locating dog sleeve 48 and the retaining dog sleeve move downward until the retaining dogs 90 fall into a provided notch on the core mandrel 56 of running tool 55, thus releasing the retaining dogs 90 from its engaged position with fish-neck 4.

Further downward movement of the running tool 55 causes compression of fish-neck 4 downward, until the expander sleeve 12 is driven behind the locking dogs 42. This action causes the expander sleeve 12 to push the lock ring 100 over the lower locking ridge 30, thereby locking it into a permanent downward position. Serrations 47 and 16 engage, and expander sleeve 12 now holds the locking dogs 42 in an outwardly locked position.

Further downward pressure upon the running tool 55 shears the lower shear pin 98, and at this point, the running tool 55 is totally disengaged from lock 2. Thus, lock 2 is set, and running tool 55 can be withdrawn from the well bore 110. It must be noted that serrations 47 of expander sleeve 12 and serrations 16 of the locking dogs 42 are slightly angled so that an upward movement or upward pressure on the tool is transmitted by means of a slight upward motion of the expander sleeve 12, which only forces the locking dogs 42 outwardly into tight engagement within the landing nipple 120. Thus, locking force actually increases within the increase of downward pressure.

To reverse the process and remove the tool, a separate retrieving tool is used which is designed to lock into engagement with fish neck hole of lock 2. The retrieving tool lowers into the bore of the fish-neck until it encounters the lower, small diameter ridges, and can descend no further. A lifting force is applied to the retrieving tool, causing the expander sleeve 12 to pull free from the locking dogs 42, and causing them to withdraw into the lock. As was indicated above, lock ring 100 was previously locked in a downward position and cannot travel behind the locking dogs 42. Therefore, continued upward pull on the retrieving tool releases and retrieves lock 2 from the well bore 110.

A more detailed discussion of the operation of the present invention will be set forth below.

In operation the M-X lock 2 is assembled to the running tool 55 and secured to the running tool 55 by inserting upper shear pin 96 so as to fasten together core 56 and upper collar 70 through upper shear pin aperture 57. Lower shear pin 98 is then inserted so as to connect core 56 and packer lower sleeve section 32 through pin apertures 33 and 68. When the combined tools 55 and 2 are so assembled, the core 56 serves as a support member securing the M-X lock 2 for manipulation, in a manner to be described, by the running tool 55.

Manipulation of the locating dog sleeve 72 with respect to the running tool upper collar 70 "cocks" the combined tools. The "cocked" condition is such that the combined bias forces of upper spring 77 and lower spring 78 position locating dog 76 such that the dog engaging head 81 rests on locating dog ridge 59. Thereby head 81 extends outward of locating dog apperture 73 to position outward of the outer circumference of locating dog sleeve 72.

In this position dog push sleeve section 88 is in a position such that release lug 63 is below groove 62A; lug 63 thus is held in an inward position by section 88, locking core 56 and midsleeve 71 are locked by lug 63 extending through recess 62, and no force is exerted on shear pin 96.

Recall that upper collar 70 is fixedly connected to midsleeve 71; all manipulation forces on the combined tool 55 and 2 thus are transmitted, via collar 70, through sleeve 71.

Further, the positioning of sleeve 72 is such that through the positioning of dog groove 81, the fishneck retention dogs 90 are held on core 56 at a point immediately above retention dog recess 64. In turn, the head 94 of the fishneck retention dog 90 is forced by the diameter of the core 56 into engaging relationship with fishneck recess 8 of the fishneck 4. The lengths, distances, and relative positions of the fishneck 4 and the innersleeve 20 are established by the relative positions of the core 56 and the locating dogs 76 of the running tool 55. It is to be noted that a positive mechanical connection exists through the locating dog 76, sleeve 72 section 88, the fishneck retention dog 90, and the top of the fishneck 4, thence to the position of expander sleeve 12 within the M-X Tool 2. Concurrently, core 56, connected by upper shear pin 96 to running tool 55, provides a positive mechanical connection through lower shear pin 98 to packer lower sleeve 32 through the pinning of shear pin aperture 33. In turn, the positioning of lower sleeve 32 establishes a position of lock ring 100 through the combined opposition bias spring 105 and locking dogs 42.

In this cocked condition, combined tools 55 and 2 are inserted within a wellbore 110. The inner or minimum diameter of wellbore 110 is established by polished bore section 115 which is deliberately designed to be a high tolerance, minimim diameter section within the wellbore 110 for the purpose of passing and setting up tools such as the M-X Lock 2.

Polished bore 115 exists in surrounding relationship to a landing nipple 120, which is a large diameter recess within the overall wellbore 110, and which exists to provide a positive positioning location for the placement of downhole tools, valves, or other appurtenances attached to the overall lock 2. The purpose of the lock 2 is to positively locate at a desired position within the overall wellbore 110 a tool (not shown) which is attached by means of API pin 38 to the lock 2. Landing nipples 120 are provided at downhole locations where such tools are desired to be placed.

The characteristics of landing nipples 120 which establish the operating condition for the lock 2 are that there are a plurality of landing nipples 120 whose downhole locations are approximately known from the point of view of the drillstring or oilrig operator and, for any specific M-X lock 2 of the current invention, the landing nipples 120 have been provided with beveled edges or profile 125 at both the upper and lower edges of the landing nipples in order to mate with a series of locks such as the magnaset tools which have matching locking dog profiles. Thus the M-X lock 2 or any lock which is intended to engage with the landing nipples 120 must have the characteristic that the member of the lock which engages with the landing nipple 120 (locking dog 42) must not be capable of being cammed out of position by upward or downward forces of the tool against the bevels 125.

The location of the landing nipple 120 at which it is desired to position the lock 2 is known to the drillstring operator on the oil rig floor to a degree of preciseness such that the drillstring operator can positively determine whether or not the lock 2 has been lowered past the location of the nipple 120, but in general the overall tolerances of drillstring operations are such that the location is not known precisely enough that the drillstring operator can determine exactly whether the lock 2 locking dogs 42 are positioned exactly concurrent with landing nipple 120.

Under these circumstances, the combined tools 55 and 2 are employed as follows.

The combined tool 55 and 2, in a cocked position as described above, is interconnected into a drillstring, in a manner well understood in the art, and inserted into a wellbore 110 to be lowered to engage the desired landing nipple 120. As a plurality of landing nipples 120 are installed sequentially throughout the length of bore 110, the drillstring operator lowers the drillstring until his measurements indicate that running tool 55 is beneath the desired landing nipple 120. It will be recalled that in the cocked position locking dogs 42 are biased by spring 40 to an interior position, and do not emerge beyond the diameter of locking dog sleeve 48. It will equally be recalled that locating dogs 76 are in a position such that engaging head 81 is riding upon ridge 59 and thus the outer edge of engaging head 81 extends beyond the diameter of running tool 55. As running tool 55 descends in bore 110, therefore, an upward compressing force is exerted by the walls of bore 110 and polished bore section 115 against locating dogs 76. The slip bevels 82 on the heads 81 force the dog 76 in an upward direction against the bias of lower spring 78. The overall weight of the drillstring is such to override the bias of spring 78 and the dog engaging head 81 is forced upward, into upper locating dog recess 58. This motion retracts the dog engaging head 81 and permits the running tool 55 to descend freely within the confines of bore 110 and the more restricted diameter of polished bores 115. It will be seen that the bias of lower spring 78 will force locating dogs 76 back up lower bevel 58A onto ridge 59 whenever there is sufficient bore 110 diameter to permit the outward projection of locating dogs 76. This will most clearly occur when locating dogs 76 are at the level of landing nipples 120. However, in each case the continued downward motion of the drillstring forces running tool 55 in a downward direction and forces repeated retraction of locking dogs 76 as described.

Once running tool 55 is positioned beneath the desired landing nipple 120, the direction of the drillstring travel is reversed and running tool 55 is raised. As described, locating dogs 76 expand into landing nipple 120; further raising of running tool 55 then engages locating dog engaging head 81 against polished bore 115 but with a downward force against the bias of core spring 77. In an analagous manner to the preceeding motions, this forces dog engaging head 81 into lower locating dog recess 60. The bias of core spring 77 is insufficient to force the dog engaging head 81 upward against straight edge 60A once dog engaging head 81 has entered recess 60.

This downward motion of locating dog 76 produces a corresponding downward motion of locating dog sleeve 72. This downward motion is coupled by section 88 to fishneck 4. The overall degree of motion is approximately one inch; this is less motion than would be required to drop retaining dog 90 into retaining dog recess 64 and retaining dog 90 remains fixedly engaged with fishneck 4. The motion, however, creates a downward motion of fishneck 4 of approximately one inch with respect to core 56 and thus with respect to packer 20. This motion causes end face 18 of engaging sleeve 12 to be inserted under innerbend 41 of the S spring and, thus, biases locking dogs 42 in an outward direction. Locking dogs 42 are retained against the force of S spring 40 by the diameter of polished bore 115. As running tool 55 is further raised, locking dogs 42 encounter landing nipple 120 and spring outward into landing nipple 120 by the biased force of S spring 40.

It will be recalled that lock ring 100 was retained in a downward direction against the force of bias spring 105 by contact with locking dogs 42. The outward motion of locking dog 42 into landing nipple 120 releases lock ring 100 causing it to be pushed in an upward direction by bias spring 105, under locking dogs 42 against ridge 26.

Further upward motion of running tool 55 causes the polished bore 115 immediately above landing nipple 120 to attempt, by bevel 125, to force locking dog 42 into a retracted position against the force of spring 40. This retracting force is the principal reason prior art mechanical locks could not be used with a landing nipple 120 adapted with bevels 125 for compatability with magnaset locks. However, in this particular inventive lock 2, the lock ring 100, having been raised underneath locking dogs 42, is interposed between locking dogs 42 and packer mandrel 20; the positive mechanical strength of ring 103 prevents the retraction of locking dogs 42 and securely seizes the M-S lock 2 within the landing nipple 120 against any further attempt at upward or downward motion. This is detected by the drillstring operator as a sudden increase in drillstring tension and the operator then stops the upward motion or upward force on running tool 55.

The upward movement of ring 103 underneath locking dogs 42 is stopped by contact with upper stop ridge 26 which contacts and stops motion of the ring 103 of lock ring 100.

It is necessary to understand, for the remaining actuation of the tool, that upper shearpin 96 is of a weaker strength against shearing than lower shearpin 98 and, therefore, under the application of force will shear first.

The one inch downward motion of sleeve 72 positions release lug groove 62A of section 88 over lug 63. This permits lug 63 to move outward, when cammed by beveled sides of core groove 62. The free movement of lug 63 causes all forces of sleeve 71 to bear on core 56 through shear pin 96.

The drillstring operator then sets the M-X lock by imposing a strong downward force upon running tool 55. M-X lock 2 is, as aforementioned, firmly locked into landing nipple 120 and, therefore, will not move; lower shear pin 98 transmits this rigid force to core 56, lug 63 is released and thus the downward force on running tool 55 is transmitted into a shearing force against upper shear pin 96. Upper shear pin 96 shears as running tool upper collar 70 and sleeve 71 are forced downward; core 56 then slides within running tool 55; retained by core lug 56A in slot 56B.

The downward motion of locating dog 76 is transmitted through sleeve 72 section 88 to the fishneck retention dog 90 by the movement of retention dog groove 89. As this is a significant downward motion with respect to core 56, the head 94 of the fishneck retention dogs 90 falls into retaining dog recess 64, causing heads 94 to be retracted from fishneck 4, freeing fishneck 4 from the running tool 55.

The M-X lock 2 is then fully released from the running tool 55 by a reversed, upward force, which is transmitted through core 56 to lower shear pin 98, all other connection between tool 55 and lock 2 having been released shearing lower shear pin 98 and this releases all physical contact between running tool 55 and M-X lock 2.

The previous downward motion of running tool sleeve 71 was transmitted to fishneck 4, pushing fishneck 4 to a full down position and thus causing expander sleeve 12 to be moved downward aginst lock ring 100. The downward motion of midsleeve 12 end face 18 against finger ends 101A cause lock ring 101 to be moved to a full downward position, splitting against spring force at split 102 to a larger diameter and thus riding over and latching to lower lock ridge 30 which engages within inner annular groove 104. This motion positively locks ring 100 in a downward position against bias spring 105, preventing any upward motion of lock ring 100 for the remaining usage of the M-X lock 2.

Simultaneously, the lower serrated teeth sections 16 of sleeve 12 engage with the inner serrations 47 of locking dogs 42. The combination of the thickness of expander sleeve 12, together with a substantial interlocking effect provided by the meshing of serration section 16 and serrations 47, securely clasps expander sleeve 12 under locking dogs 42 and provides a strong mechanical lock of locking dogs 42 in an outward direction into landing nipple 120. The mechanical ridigity of this locking is particularly important inasmuch as all forces imposed upon the downhole tool fastened to API pin 38 are transitted through the M-X lock 2, through locking dogs 42 and into the landing nipple 120.

The setting of M-X lock 2 is concluded by the upward movement of running tool 55 which has been released by the shearing of lower shear pin 98 and the retraction of retention dogs 90 from all engagement with M-X lock 2. Running tool 55 is removed leaving M-X lock 2 firmly engaged within landing nipple 120.

Removal of the M-X lock may be performed by any fishing tool having springloaded hooks which can engage with the fishneck recess 8 of fishneck 4. It will be recalled that the locking dogs 42 are engaged in landing nipple 120 by the presence of expander sleeve 12 which is secured by the interlocking of serrated sections 16 and inner serrations 47. These serrations are mutually of an angled thread type and may be overcome by a strong upward pull which will retract expander sleeve 12 from underneath locking dogs 42. The full upward motion of sleeve 12 removes end face 18 from under innerbend 41, causing S spring 40 to bias locking dogs 42 to an inward direction, retracting them from landing nipple 120.

The previous activation of the tool has permanently locked lock ring 100 down over lower lock ridge 30 and thus lock ring 100 will not spring back under locking dogs 42 to prevent the retraction. Locking dogs 42 have fully retracted, the entire lock 2 and the associated tool fastened to API pin 38 may then be retrieved by upward pull within wellbore 110.

I claim:

1. A mechanically actuated locking sub for setting and releasing a downhole tool from an oilwell borehole, having landing nipples, without interrupting a production flow therethrough, comprising:

an inner tubular member, having a central conduit and a lower end provided with means for attachment to the downhole tool to be set in or released from the oilwell bore;

an outer sleeve member circumferentially encompassing at least a part of said inner tubular member, said sleeve having a plurality of apertures therein;

a plurality of locking dog members intermediate said inner tubular member and said outer sleeve member, having an engaging portion extending outwardly through said apertures of said outer sleeve member;

slidable sleeve means intermediate said outer sleeve member and said inner tubular member, movable between a first, extended and a second, retracted position with respect to said inner tubular member; and a double acting spring means engaging the locking dogs, adapted to bias said locking dogs towards the inner tubular member when said sleeve means is in the extended position and adapted to bias said locking dogs outwardly from said inner tubular member when said sleeve means is in the retracted position.

2. The apparatus of claim 1, further comprising:

a split locking ring member annularly disposed for sliding upon said inner tubular member, slidable from a first to a second position thereupon;

bias means for urging said annular ring towards the second position;

latching means for latching said ring in the latching position against the force of said bias means;

latching means for latching said ring in said latching position;

said first position being intermediate said inner sleeve and said locking dogs, fixedly supporting said locking dogs in the extended position; and said ring being forced into said second position by said slidable sleeve in the retracted position.

3. A mechanically actuated locking sub for setting in and releasing a downhole tool from an oilwell bore, having a plurality of landing nipples, without interrupting a production flow through the oilwell bore, comprising:

a hollow tubular member provided with means for attaching the downhole tool to be set or released at one end thereof;

an outer sleeve circumferentially attached about at least a portion of the hollow tubular member, said outer sleeve being provided with a plurality of apertures;

an inner sleeve coaxially mounted with the hollow tubular member in a limited slidable relationship within the outer sleeve;

a plurality of locking means mounted between said inner sleeve and said outer sleeve with at least a portion of said locking means extending through the outer sleeve apertures, said locking means being movable between a first, extended position, in engagement with the landing nipples and a second, retracted position, out of engagement with the landing nipples;

bias means for moving said locking means between the first and the second positions;

an annular split lock ring circumferentially mounted on said hollow tubular member and movable between a first position, fixedly retaining said locking means in the extended position, and a second position, allowing the locking means to remain in the retracted position; and spring means urging said annular lock ring towards the second position.

4. The apparatus of claim 3, wherein at least a portion of said inner sleeve and at least a portion of said locking means are provided with matching serrations engageable when the locking means are in their extended position.

5. The apparatus of claim 3, wherein said hollow tubular member is provided with a means for limiting movement of said split lock ring in relation to the hollow tubular member in the direction opposite from said inner sleeve.

* * * * *